US007081000B1

(12) United States Patent
Senigla

(10) Patent No.: US 7,081,000 B1
(45) Date of Patent: Jul. 25, 2006

(54) MODULAR DAISY-CHAIN FLANGE MOUNT FOR COAXIAL CONNECTORS

(75) Inventor: Steven T. Senigla, Slaterville Springs, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 11/102,669

(22) Filed: Apr. 11, 2005

(51) Int. Cl.
*H01R 13/62* (2006.01)

(52) U.S. Cl. ..... 439/306; 439/290; 439/284

(58) Field of Classification Search ..... 439/289–290, 439/284, 306
See application file for complete search history.

(56) References Cited

U.S. PATENT DOCUMENTS

| | | | | |
|---|---|---|---|---|
| 4,911,659 | A | 3/1990 | Viselli | |
| 5,575,674 | A * | 11/1996 | Davis et al. | 439/284 |
| 6,234,838 | B1 | 5/2001 | Wong | |
| 6,334,794 | B1 * | 1/2002 | Crane et al. | 439/680 |
| 6,386,888 | B1 | 5/2002 | Skopic et al. | |
| 6,422,900 | B1 | 7/2002 | Hogan | |
| D474,155 | S * | 5/2003 | Wu | D13/147 |
| 6,692,299 | B1 | 2/2004 | Stockmaster | |
| 6,776,656 | B1 | 8/2004 | Lehtonen et al. | |

* cited by examiner

*Primary Examiner*—Truc Nguyen
(74) *Attorney, Agent, or Firm*—Schwartz & Weinrieb

(57) ABSTRACT

A new and improved radio frequency coaxial connector mounting flange structure, to be mounted upon a radio frequency system subassembly, comprises a modular component which has recessed end portions for enabling adjacent coaxial connector mounting flange structures to effectively overlap each other, when a plurality of the coaxial connector mounting flange structures are disposed within a longitudinal, horizontally oriented array, such that not only can the longitudinal extent of the longitudinal array of the plurality of coaxial connector mounting flange structures be minimized, but in addition, the overall longitudinal extent of the radio frequency system subassembly can be reduced. Still further, the overlapped end portions of the adjacent coaxial connector mounting flange structures can effectively be secured onto the radio frequency system subassembly by a common fastener thereby effectively reducing the number of fasteners and the corresponding time to install such fasteners.

20 Claims, 3 Drawing Sheets

MODULAR DAISY-CHAIN FLANGE MOUNT FOR COAXIAL CONNECTORS

FIELD OF THE INVENTION

The present invention relates generally to electrical connector mounting flange structures, electrical connector mounting flange systems, and radio frequency system subassemblies having such electrical connector mounting flange structures and electrical connector mounting flange systems mounted thereon, and more particularly to new and improved coaxial connector mounting flange structures, to be mounted upon radio frequency system subassemblies, wherein the new and improved coaxial connector mounting flange structures comprise modular components which have recessed, relieved, or offset end portions which enable adjacent coaxial connector mounting flange structures to effectively overlap each other whereby not only can the longitudinal extent of a longitudinal array of a plurality of coaxial connector mounting flange structures be minimized, but in addition, the overall longitudinal extent or dimension of the radio frequency system subassembly can be reduced as compared to the overall longitudinal extent or dimension of a radio frequency system subassembly having standard coaxial connector mounting flange structures mounted thereon. The connection of a multiplicity of coaxial cables onto the radio frequency system subassembly is thus rendered more spatially efficient than has been previously capable of being achieved by means of standard radio frequency coaxial connector mounting flange structures, whereby more coaxial connections can be made within a predetermined package volume, space, or housing, and this is especially important within those environments, such as, for example, military aircraft, satellites, commercial aircraft, and the like, wherein the amount of space that is available for accommodating electronic apparatus is always at a premium. Still further, the overlapped end portions of the adjacent coaxial connector mounting flange structures can effectively be secured onto the radio frequency system subassembly by means of a common fastener thereby effectively reducing the number of fasteners, and the corresponding time to install such fasteners, which are required to secure the plurality of coaxial connector mounting flange structures upon the radio frequency system subassembly.

BACKGROUND OF THE INVENTION

Radio frequency system subassemblies comprise circuit devices or components, which are internally embedded within the radio frequency system subassemblies, and hermetically sealed field replaceable pins, which comprise glass seal structures, which effectively define electrical connections or interfaces between the internally embedded circuit components or devices and external coaxial connectors under hermetically sealed conditions so as to prevent the internally embedded circuit components or devices from being exposed to any corrosive elements which may be present within the ambient environment. Coaxial cables are adapted to be connected to the coaxial connectors so as to effectively be electrically connected to the circuit components or devices internally embedded within the radio frequency system subassemblies, however, when a multiplicity of coaxial cables are to be electrically connected to the radio frequency system subassemblies in order to electrically connect such coaxial cables to the circuit components or devices internally embedded within the radio frequency system subassemblies, each one of the coaxial cables is adapted to be connected to a respective one of the plurality of hermetically sealed field replaceable pins of the radio frequency system subassemblies by means of coaxial connectors which are individually mounted upon coaxial connector mounting flange structures.

More particularly, as can best be appreciated from FIG. 1, a conventional radio frequency system subassembly is disclosed and is generally indicated by the reference character 10, and in order to provide electrical connections to the aforenoted circuit devices or components, internally embedded within the radio frequency system subassembly 10 but not shown in the drawing, through means of the aforenoted hermetically sealed field replaceable pins, also not shown in the drawing, a suitable coaxial electrical connector 12, to which a coaxial cable, also not shown in the drawing, is to be connected, is integrally and individually incorporated upon a separate standard coaxial connector mounting flange structure 14. It is seen that each one of the standard coaxial connector mounting flange structures 14 has a substantially elongated, elliptical or oval-shaped configuration, and that the coaxial electrical connector 12 is mounted upon a respective one of the standard coaxial connector mounting flange structures 14 at a central region thereof. In addition, a pair of hexagonal-head threaded fasteners 16,16 are adapted to be inserted through opposite end portions of each one of the standard coaxial connector mounting flange structures 14 so as to fixedly mount the standard coaxial connector mounting flange structures 14 upon, for example, the external wall surface 18 of the radio frequency system subassembly 10. In this manner, it can be readily appreciated that each one of the standard coaxial connector mounting flange structures 14 effectively defines a standard single-pin radio frequency coaxial connector mounting flange structure, and that once the electrical connections are in fact made between each one of the coaxial electrical connectors 12 and the corresponding one of the hermetically sealed field replaceable pins, not shown in the drawing, the integrity of the electrical connection, defined between each coaxial cable, not shown in the drawing, and the particular one of the hermetically sealed field replaceable pins, also not shown in the drawing, of the circuit device or component, not shown in the drawing, will be able to be preserved despite external forces which may be impressed upon the coaxial cables electrically connected to the coaxial electrical connectors 12.

Each one of the aforenoted standard single-pin radio frequency coaxial connector mounting flange structures 14 has of course been satisfactory from the viewpoint of reliably securing the coaxial cables and their respective coaxial electrical connectors 12 upon the radio frequency system subassembly 10 such that the coaxial cables and their respective coaxial electrical connectors 12 can assuredly be connected to the hermetically sealed field replaceable pins, not shown in the drawing, of the circuit device or component, also not shown in the drawing. It can readily be appreciated, however, that when each one of the standard single-pin coaxial connector mounting flange structures 14 is mounted in its normal horizontal orientation upon one of the external wall surfaces 18 of the radio frequency system subassembly 10 as illustrated within FIG. 1, each one of the standard single-pin coaxial connector mounting flange structures 14 will exhibit a predetermined laterally or horizontally oriented width dimension.

More particularly, in view of the fact that each one of the coaxial electrical connectors 12 is disposed at the central region of each one of the standard single-pin coaxial connector mounting flange structures 14, and correspondingly, in view of the additional fact that the pair of threaded fasteners 16,16 are disposed within the opposite end portions of each one of the standard single-pin coaxial connector mounting flange structures 14, then it is readily apparent that each one of the coaxial electrical connectors 12 is disposed a predetermined distance from each oppositely disposed external end portion of its standard single-pin coaxial connector mounting flange structure 14. Accordingly, when, for example, a pair of standard single-pin coaxial connector mounting flange structures 14,14 are to be disposed in an adjacent, side-by-side, abutting array or arrangement so as to enable the coaxial cables and the coaxial connectors 12 of the pair of standard single-pin coaxial connector mounting flange structures 14,14 to mate with the hermetically sealed field replaceable pins of the different circuit devices or components disposed internally within the radio frequency system subassembly 10, the minimum center-to-center distance defined between the pair of coaxial electrical connectors 12,12 is significant or substantial, or in other words, is, in fact, equal to twice the distance defined between one of the coaxial electrical connectors 12 and one of the oppositely disposed end portions of each one of the standard single-pin coaxial connector mounting flange structures 14.

Therefore it is to be appreciated still further that such center-to-center distance defined between the pair of coaxial electrical connectors 12, 12 disposed upon the pair of adjacent, side-by-side, and abutting standard single-pin coaxial connector mounting flange structures 14,14 will necessarily dictate the minimum center-to-center distance that can be defined between the hermetically sealed field replaceable pins of the circuit devices or components disposed internally within the radio frequency system subassembly 10. Viewed from a different perspective, the provision or disposition of the circuit devices or components, not shown in the drawing, and the provision or disposition of the hermetically sealed field replaceable pins operatively associated therewith and also not shown in the drawing, internally within the radio frequency system subassembly 10 must correspond to the disposition of the pair of coaxial electrical connectors 12,12 disposed upon the pair of adjacent, side-by-side, and abutting standard single-pin coaxial connector mounting flange structures 14,14. Therefore, the provision or disposition of the circuit devices or components, not shown in the drawing, and the provision or disposition of the hermetically sealed field replaceable pins operatively associated therewith but also not shown in the drawing, internally within the radio frequency system subassembly 10 cannot be achieved in a relatively compact manner. Accordingly, when in fact a plurality of the standard single-pin coaxial connector mounting flange structures 14, such as, for example, three of such standard single-pin coaxial connector mounting flange structures 14 as disclosed within FIG. 1, are mounted upon the radio frequency system subassembly 10, the radio frequency system subassembly 10 will necessarily exhibit predetermined length, volume, and spatial parameters or characteristics whereby the location or accommodation of such radio frequency assemblies 10 within predetermined spatial requirements or housings becomes problematic.

In an attempt to rectify the aforenoted spatial problems comprising the center-to-center distance defined between any pair of adjacent, side-by-side, and abutting standard single-pin coaxial connector mounting flange structures 14,14, it has been proposed to mount pairs of adjacent, side-by-side, standard single-pin coaxial connector mounting flange structures 14,14 at predetermined angles with respect to each other so as to effectively alter the resulting center-to-center distance defined between the pair of adjacent, side-by-side, standard single-pin coaxial connector mounting flange structures 14,14. As can readily be appreciated from FIG. 2, a plurality of adjacent, side-by-side, standard single-pin coaxial connector mounting flange structures 114,114,114 may be disposed at an angle of, for example, 45° with respect to the original horizontal orientation of the plurality of coaxial connector mounting flange structures 14,14,14 as disclosed within FIG. 1, either in an abutting or non-abutting relationship, such that any pair of coaxial electrical connectors 112,112, disposed upon any pair of adjacent, side-by-side, standard single-pin coaxial connector mounting flange structures 114,114, will not only be disposed within the same horizontal plane as those of the original coaxial electrical connectors 12,12 so as to be capable of electrically mating with the pair of hermetically sealed field replaceable pins, not shown in the drawing, of the radio frequency system subassembly 110, but in addition, the center-to-center distance defined between each pair of coaxial electrical connectors 112,112 will be less than the center-to-center distance defined between each pair of coaxial electrical connectors 12,12 when the pair of adjacent, side-by-side, and abutting, standard single-pin coaxial connector mounting flange structures 14,14 were disposed in their horizontal orientation as disclosed within FIG. 1.

As a further alternative, the pairs of adjacent, side-by-side, standard single-pin coaxial connector mounting flange structures 114,114 may be disposed in a substantially vertical or 90° orientation with respect to each other, either in an abutting or non-abutting relationship. In this manner, again, not only will the coaxial electrical connectors 112,112 of each pair of adjacent, side-by-side, standard single-pin coaxial connector mounting flange structures 114, 114 be disposed within the same horizontal plane as those of the original coaxial electrical connectors 12,12 so as to be capable of electrically mating with the pair of hermetically sealed field replaceable pins, not shown in the drawing, of the radio frequency system subassembly 110, but in addition, the center-to-center distance defined between each pair of coaxial electrical connectors 112,112 will be less than the center-to-center distance defined between each pair of coaxial electrical connectors 12,12 when the pairs of adjacent, side-by-side, and abutting standard single-pin coaxial connector mounting flange structures 14,14 were disposed in their horizontal orientation as disclosed within FIG. 1.

While the aforenoted 45° angularly oriented, or 90° vertically oriented, arrangements or dispositions of the pairs of adjacent, side-by-side, and abutting standard single-pin coaxial connector mounting flange structures 114,114, as disclosed within FIG. 2, effectively resolved the problem concerning the center-to-center distance defined between each pair of coaxial electrical connectors 12,12 when each pair of adjacent, side-by-side, and abutting standard single-pin co-axial connector mounting flange structures 14,14, were disposed in their horizontal orientation as disclosed within FIG. 1, whereby, for example, the overall width dimension $W_1$, characteristic of the radio frequency system subassembly 10, was able to be effectively reduced to an overall width dimension $W_2$, characteristic of the radio frequency system subassembly 110, the disposition of the pairs of adjacent, side-by-side, standard single-pin coaxial connector mounting flange structures 114,114 at their relative 45° angular orientation, such as, for example, as illustrated within FIG. 2, or within their vertical or 90° orientation, not illustrated, presented or created an additional problem. In particular, it can readily be appreciated that when each pair of adjacent, side-by-side, standard single-pin coaxial connector mounting flange structures 114,114 are disposed in either one of their 45° angular, or 90° vertical, orientations, the relative height dimension or depth profile, as defined between the oppositely disposed end portions of each one of the pair of adjacent, side-by-side, standard single-pin coaxial connector mounting flange structures 114, 114, within which the bolt fasteners 116,116 are disposed, is substantially increased to a dimension $D_2$ as compared to the relative height dimension or depth profile $D_1$ characteristic of any one of the standard single-pin coaxial connector mounting flange structures 14, as defined between the upper and lower edge portions of the standard single-pin coaxial connector mounting flange structures 14, when the standard single-pin coaxial connector mounting flange structures 14, 14 are disposed in their horizontal mode as illustrated in FIG. 1. Accordingly, again, the various radio frequency system subassemblies 110 will necessarily exhibit predeterminedly large depth, size, volume, and spatial parameters or characteristics when the plurality of such 45° angularly oriented, or 90° vertically oriented, standard single-pin coaxial connector mounting flange structures 114 are mounted thereon, whereby the location or accommodation of such radio frequency system subassemblies 110 within predetermined spatial requirements or housings still remains problematic.

A need therefore exists in the art for a new and improved radio frequency coaxial connector mounting flange structure wherein not only can the center-to-center distance defined between adjacent coaxial electrical connectors effectively be minimized, so as to, in turn, reduce the overall width dimension characteristic of the radio frequency system subassembly when a plurality of radio frequency coaxial connector mounting flange structures are fixedly mounted upon the radio frequency system subassembly, but in addition, the overall height dimension or depth profile of the radio frequency system subassembly can likewise be maintained as small as possible so as to permit such radio frequency system subassemblies to be readily and easily accommodated within predetermined spatial requirements or housings as may be necessary, such as, for example, within military or commercial aircraft, satellites, and the like, wherein the amount of space that is available for accommodating electronic apparatus is always at a premium.

SUMMARY OF THE INVENTION

The foregoing and other objectives are achieved in accordance with the teachings and principles of the present invention through the provision of new and improved radio frequency coaxial connector mounting flange structures, to be mounted upon a radio frequency system subassembly, wherein each one of the new and improved radio frequency coaxial connector mounting flange structures comprises a modular component which has recessed, relieved, or offset end portions. Such recessed, relieved, or offset end portions of each modular coaxial connector mounting flange structure enable adjacent coaxial connector mounting flange structures to effectively overlap each other when a plurality of the coaxial connector mounting flange structures are disposed within a longitudinal, horizontally oriented array.

In this manner, not only can the longitudinal extent of the longitudinal array of the plurality of coaxial connector mounting flange structures be minimized, but in addition, the overall longitudinal extent or dimension of the radio frequency system subassembly can be reduced as compared to the overall longitudinal extent or dimension of a radio frequency system subassembly having standard coaxial connector mounting flange structures mounted thereon. The connection of a multiplicity of coaxial cables onto the radio frequency system subassembly is thus rendered more spatially efficient than has been previously capable of being achieved by means of standard radio frequency coaxial connector mounting flange structures, whereby more coaxial connections can be made within a predetermined package volume, space, or housing, and this is especially important within those environments, such as, for example, military aircraft, satellites, commercial aircraft, and the like, wherein the amount of space that is available for accommodating electronic apparatus is always at a premium. Still further, the overlapped end portions of the adjacent coaxial connector mounting flange structures can effectively be secured onto the radio frequency system subassembly by means of a common fastener thereby effectively reducing the number of fasteners, and the corresponding time to install such fasteners, which are required to secure the plurality of coaxial connector mounting flange structures upon the radio frequency system subassembly.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE ILLUSTRATED EMBODIMENTS

Figure 1:
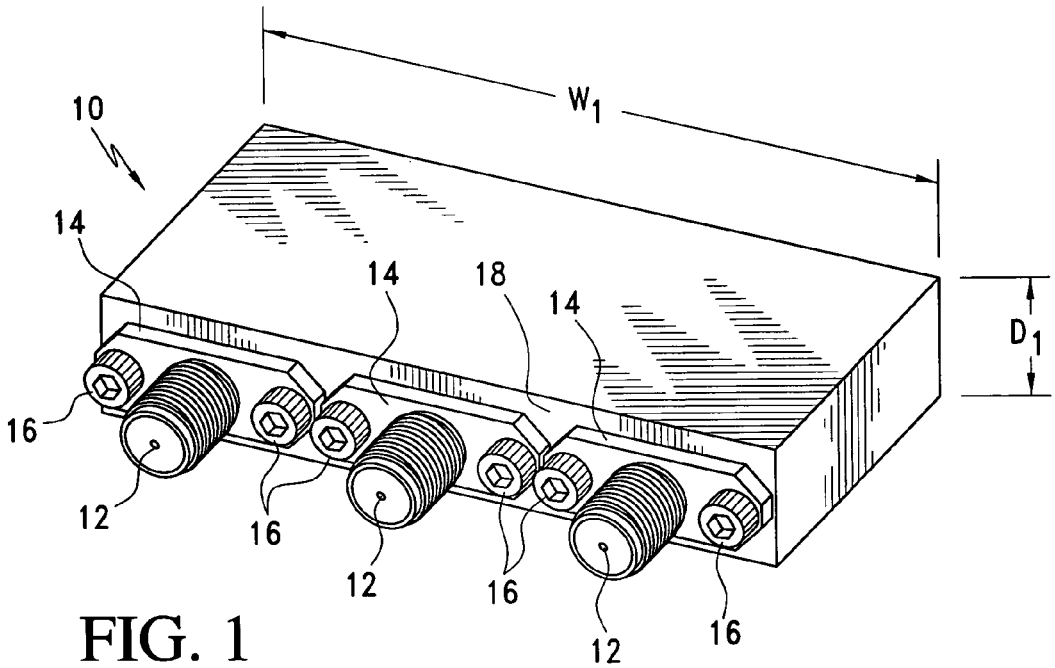
FIG. 1 (PRIOR ART)
FIG. 1 is a perspective view of a first embodiment radio frequency system subassembly having a plurality of conventional, PRIOR ART, standard single-pin coaxial connector flange structures mounted thereon in a horizontal, side-by-side array.
Figure 2:
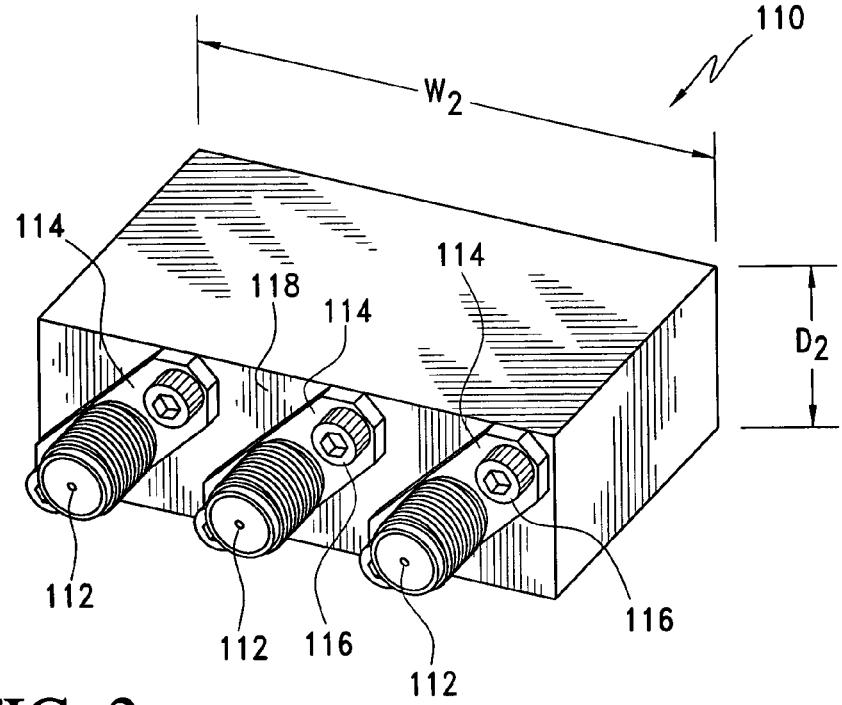
FIG. 2 (PRIOR ART)
FIG. 2 is a perspective view of a second embodiment radio frequency system subassembly showing the mounting of a plurality of conventional, PRIOR ART, standard single-pin coaxial connector flange structures upon the radio frequency system subassembly at a 45° angular disposition wherein the width dimension of the second embodiment radio frequency system subassembly is reduced as compared to that of the first embodiment radio frequency system subassembly disclosed within FIG. 1, however, the height dimension or depth profile of the second embodiment radio frequency system subassembly is enlarged as compared to that of the first embodiment radio frequency system subassembly as disclosed within FIG. 1.
Figure 3:
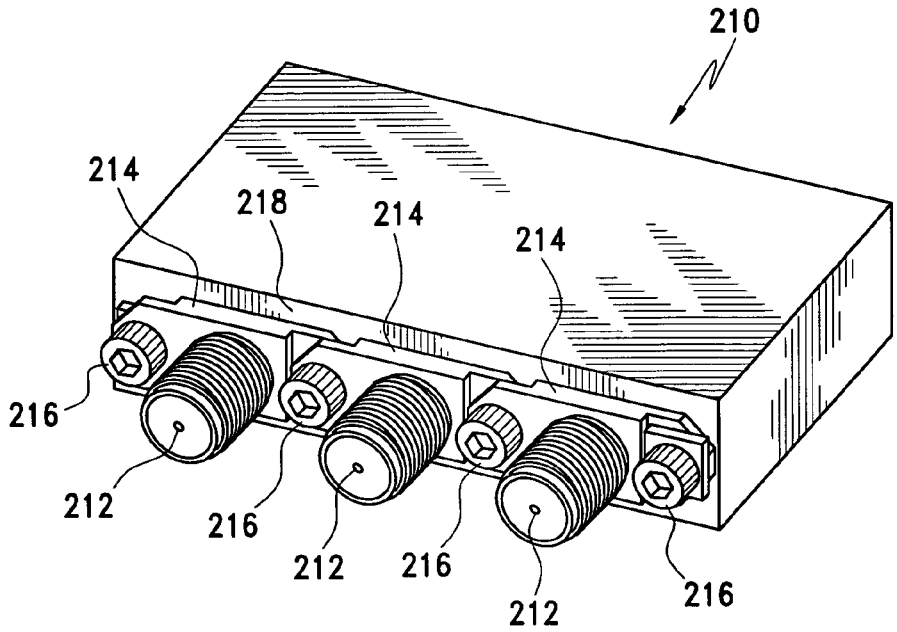
FIG. 3 is a perspective view, similar to that of FIG. 1, showing, however, a new and improved radio frequency system subassembly, having a plurality of new and improved radio frequency coaxial connector mounting flange structures, constructed in accordance with the principles and teachings of the present invention, mounted upon the new and improved radio frequency system subassembly, wherein the width dimension or lateral extent of the radio frequency system subassembly is able to be reduced as compared to that of the first embodiment radio frequency system subassembly as disclosed within FIG. 1, and yet, the height dimension or depth profile of the new and improved radio frequency system subassembly is able to be maintained or preserved so as to match or correspond to the height dimension or depth profile of the first embodiment, conventional, PRIOR ART radio frequency system subassembly as disclosed within FIG. 1.
Figure 4:
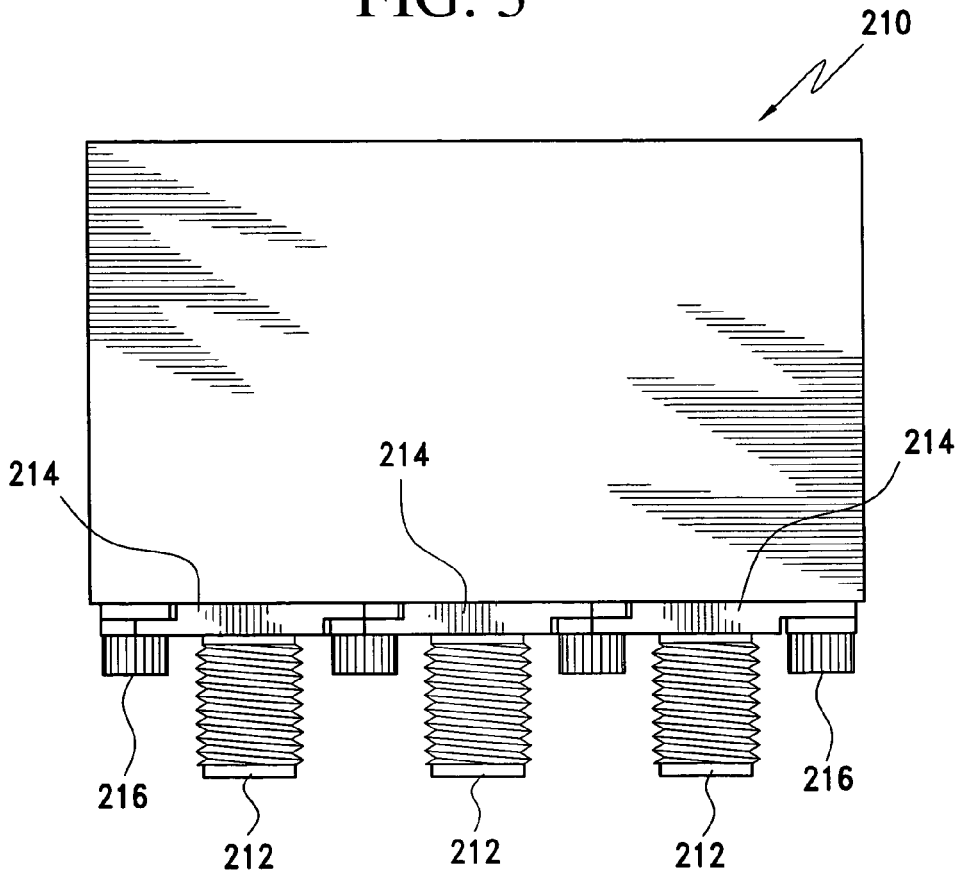
FIG. 4 is a top plan view of the new and improved radio frequency system subassembly of the present invention as disclosed within FIG. 3.

Referring now to the drawings, and more particularly to FIGS. 3 and 4 thereof, a new and improved radio frequency system subassembly, constructed in accordance with the principles and teachings of the present invention, is disclosed and is generally indicated by the reference char0acter 210. It will be initially appreciated that the various components comprising the new and improved radio frequency system subassembly 210, and which correspond, for example, to the various components comprising the conventional, PRIOR ART radio frequency system subassemblies 10,110, as respectively disclosed within FIGS. 1 and 2, will be designated by corresponding reference numerals except that the reference numerals will be within the 200 series. More particularly, as can best be appreciated from FIGS. 3 and 4, a plurality of coaxial electrical connectors 212, to which a plurality of coaxial cables, not shown in the drawing, are to be connected, are respectively integrally incorporated upon a plurality of new and improved coaxial connector mounting flange components 214 which have been constructed in accordance with the principles and teachings of the present invention, and the plurality of new and improved coaxial connector mounting flange components 214 are adapted to be fixedly secured, by means of a plurality of threaded fasteners 216, onto, for example, an external wall surface portion 218 of the new and improved radio frequency system subassembly 210. The plurality of new and improved coaxial connector mounting flange components 214 are disposed within a horizontal array, and in accordance with the unique and novel structure characteristic of each one of the plurality of new and improved coaxial connector mounting flange components 214, opposite end portions of adjacent ones or adjacent pairs of the new and improved coaxial connector mounting flange components 214 are able to be overlapped with respect to each other so as to effectively minimize the longitudinal extent or overall length dimension of the horizontal array of the coaxial connector mounting flange components 214, and the coaxial electrical connectors 212 respectively mounted thereon, which, in turn, effectively reduces the longitudinal extent or overall length dimension or width dimension of the new and improved radio frequency system subassembly 210.

Figure 5:
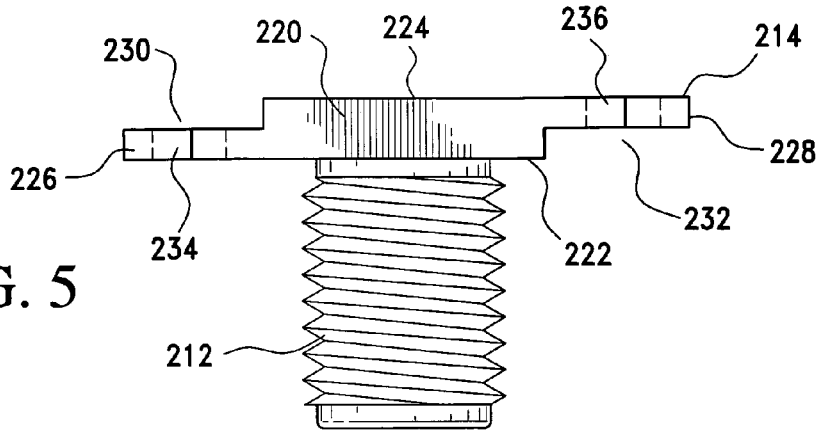
FIG. 5 is a top plan view of a new and improved radio frequency coaxial connector mounting flange structure as constructed in accordance with the principles and teachings of the present invention, wherein the structural details of the radio frequency coaxial connector mounting flange structure are disclosed, including, in particular, the oppositely disposed or oriented relieved, recessed, or offset end portions which will permit adjacent ones of the radio frequency coaxial connector mounting flange structures to be overlapped with respect to each other in a compact array.
Figure 6:
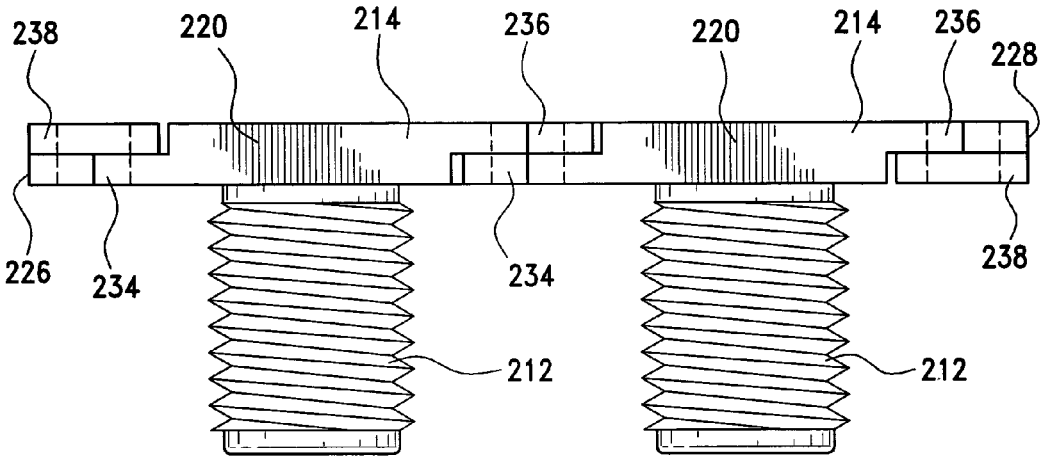
FIG. 6 is a top plan view of a pair of the new and improved radio frequency coaxial connector mounting flange structures, as has been disclosed within FIG. 5, as the same would be positioned with respect to each other when mounted upon the new and improved radio frequency system subassembly, as has been disclosed within FIG. 4, wherein the structural features comprising the relieved, recessed or offset end portions of the radio frequency coaxial connector mounting flange structures permit the end portions of the radio frequency coaxial connector mounting flange structures to be disposed in an overlapped manner with respect to each other so as to achieve a compact array when mounted upon a radio frequency system subassembly.
Figure 7:
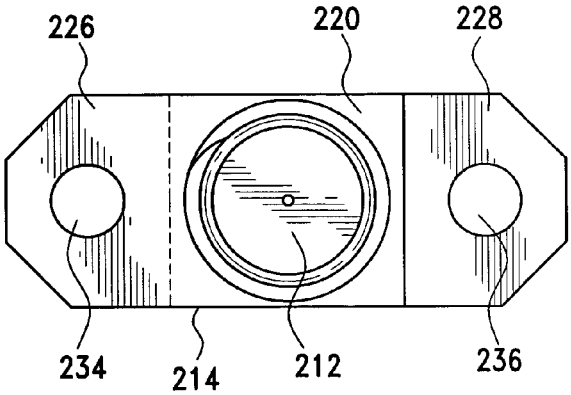
FIG. 7 is a front elevational view of the new and improved radio frequency coaxial connector mounting flange structure as has been disclosed within FIG. 5.

With reference now being made to FIGS. 5–7, the particularly unique and novel structure, which is characteristic of each one of the new and improved coaxial connector mounting flange components 214, and which enables the aforenoted overlapping of the end portions of adjacent ones or adjacent pairs of such coaxial connector mounting flange components 214, will now be described. More particularly, it is seen that each one of the new and improved coaxial connector mounting flange components 214 comprises a central body portion 220 having a forward or front surface portion 222 and a backward or rear surface portion 224. End portions 226,228 of each coaxial connector mounting flange component 214 extend laterally outwardly from opposite ends of the central body portion 220, and it is seen that the left end portion 226 is effectively relieved or recessed along, or with respect to, the rear surface portion 224, as at 230, while the right end portion 228 is effectively relieved or recessed along, or with respect to, the front surface portion 222, as at 232. In this manner, the left and right end portions 226,228 of each coaxial connector mounting flange component 214 effectively forms or defines an offset flange structure which has a thickness dimension which is approximately one-half the thickness dimension of the central body portion 220.

It is to be noted further that each one of the coaxial connector mounting flange components 214 has a substantially identical structure whereby each one of the coaxial connector mounting flange components 214 comprises a modular unit, and accordingly, a plurality of such coaxial connector mounting flange components 214 can be arranged within a longitudinal array, as disclosed within FIGS. 3, 4, and 6, wherein a left end portion 226 of a particular one of the plurality of coaxial connector mounting flange components 214 can effectively overlap a right end portion 228 of an adjacent one of the plurality of coaxial connector mounting flange components 214. This is to be distinguished from the arrangement of the conventional PRIOR ART coaxial connector mounting flange structures 14, as disclosed within FIG. 1, wherein the left end portion of a particular one of the plurality of coaxial connector mounting flange structures 14 is disposed in abutting contact with the right end portion of an adjacent one of the plurality of coaxial connector mounting flange structures 14. Accordingly, it can be appreciated that each time an adjacent pair of the new and improved coaxial connector mounting flange components 214 are effectively mated with respect to each other such that the left end portion 226 of a first one of the pair of coaxial connector mounting flange components 214 effectively overlaps a right end portion 228 of a second one of the pair of coaxial connector mounting flange components 214, the overall length dimension of the array comprising the plurality of coaxial connector mounting flange components 214 is effectively shortened by means of a distance or lineal amount which is equal to the longitudinal extent or width dimension characteristic of one of the end portions 226,228 of any one of the coaxial connector mounting flange components 214. Accordingly, the overall length dimension, longitudinal extent, or width dimension of each radio frequency system subassembly 210 is correspondingly shortened or reduced so as to permit such radio frequency system subassembly 210 to be disposed or accommodated within environments characterized by limited spatial parameters.

Continuing further, and with particular reference being made to FIGS. 5–7, it is seen that each one of the left and right relieved, recessed, or offset end portions 226,228 of each one of the modular coaxial connector mounting flange components 214 is respectively provided with a throughbore or aperture 234,236 for accommodating the passage therethrough of one of the threaded fasteners 216. As has been noted hereinbefore, the relieved, recessed, or offset end portions 226,228 of adjacent coaxial connector mounting flange components 214 are adapted to be overlapped with respect to each other, and accordingly, when in fact a left end portion 226 of a first one of the coaxial connector mounting flange components 214 is overlapped with respect to a right end portion 228 of a second one of the coaxial connector mounting flange components 214, the through-bores or apertures 234,236 of the two coaxial connector mounting flange components 214 will be coaxially aligned with respect to each other so as to permit a single threaded fastener 216 to be inserted therethrough, as can be readily appreciated from FIGS. 3 and 4, whereby the single threaded fastener 216 can secure two opposite overlapped end portions of two separate coaxial connector mounting flange components 214. As can therefore be readily appreciated by means of a further comparison of, for example, FIG. 3 with FIG. 1, while six threaded fasteners 16 were required to fixedly secure the three coaxial connector mounting flange structures 14 upon the radio frequency system subassembly 10, only four threaded fasteners 216 are required to fixedly secure the three coaxial connector mounting flange structures 214 upon the radio frequency system subassembly 210.

As has been noted hereinbefore, the thickness dimension of each one of the end portions 226,228 of each one of the modular coaxial connector mounting flange components 214, as a result of being relieved as at 230,232, is approximately one-half the thickness dimension of the central body portion 220. Accordingly, the left end flange structure 226 of the leftmost one of the coaxial connector mounting flange components 214 will normally be spaced away from the external wall surface 218 of the radio frequency system subassembly 210 in view of the fact that the left end flange structure 226 of the leftmost one of the coaxial connector mounting flange components 214 is not disposed atop or overlapped upon a corresponding right end flange structure 228 of another one of the coaxial connector mounting flange components 214. Therefore, it can be readily appreciated that if one of the threaded fasteners 216 is to be passed through the left end flange structure 226 of the leftmost one of the coaxial connector mounting flange components 214 as shown in FIGS. 3 and 4 so as to fixedly secure the leftmost one of the coaxial connector mounting flange components 214 to the external wall surface 218 of the radio frequency system subassembly 210, the left end flange structure 226 of the leftmost one of the coaxial connector mounting flange components 214 will be bent and not be properly seated in a flush or surface-to-surface manner upon the external wall surface 218 of the radio frequency system subassembly 210. Similar problems will be encountered in connection with the right end flange structure 228 of the rightmost one of the coaxial connector mounting flange components 214 in that since the head of the threaded fastener 216 would be seated within the relieved or recessed portion 232, the threaded fastener 216 would in effect be too long to properly secure the right end flange structure 228 of the rightmost one of the coaxial connector mounting flange components 214 onto the external wall surface 218 of the radio frequency system subassembly 210.

Figure 8:
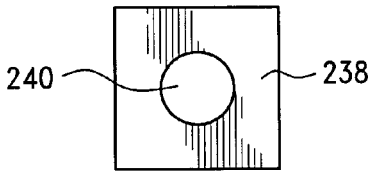
FIG. 8 is a front elevational view of a spacer member utilized in conjunction with the relieved end portions of the endmost new and improved radio frequency coaxial connector mounting flange structures disposed within the longitudinal array of new and improved radio frequency coaxial connector mounting flange structures as mounted upon a radio frequency system subassembly as disclosed within FIGS. 3 and 4.
Figure 9:
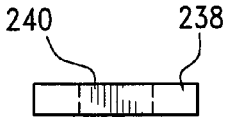
FIG. 9 is a top plan view of the spacer member disclosed within FIG. 8.

Therefore, in order to permit the threaded fasteners 216 to properly secure the left and right flange structures 226,228 of the leftmost and rightmost coaxial connector mounting flange components 214 onto the external wall surface 218 of the radio frequency system subassembly 210, a spacer 238, as disclosed within FIGS. 8 and 9, is employed. As can be seen from FIGS. 8 and 9, each spacer 238 has a substantially square-shaped cross-sectional configuration, although other geometrical configurations are possible, and a thickness dimension which is substantially the same as the thickness of the relieved or recessed regions 230,232 so as to permit the spacers 238 to be accommodated therewithin as can be readily seen and appreciated from FIG. 6. Each one of the spacers 238 is also provided with a throughbore or aperture 240 within the central region thereof so as to permit each one of the threaded fasteners 216 to pass therethrough. Therefore, by employing the spacers 238 in connection with the endmost ones of the coaxial connector mounting flange components 214, and in the manner disclosed within FIG. 6, the left end flange structure 226 of the leftmost one of the coaxial connector mounting flange components 214 will be properly supported by means of the spacer 238 such that the threaded fastener 216 can properly secure the left end flange structure 226 of the leftmost one of the coaxial connector mounting flange components 214 upon the external wall surface 218 of the radio frequency system subassembly 210, and in a similar manner, the head of the threaded fastener 216 will be seated upon the spacer 238 operatively associated with the right end flange structure 228 of the rightmost one of the coaxial connector mounting flange components 214 so as to likewise properly secure the right end flange structure 228 of the rightmost one of the coaxial connector mounting flange components 214 upon the external wall surface 218 of the radio frequency system subassembly 210.

Thus, it may be seen that in accordance with the principles and teachings of the present invention, there has been disclosed a new and improved radio frequency coaxial connector mounting flange structure, to be mounted upon a radio frequency system subassembly, wherein each one of the new and improved radio frequency coaxial connector mounting flange structures comprises a modular component which has recessed, relieved, or offset end portions. Such recessed, relieved, or offset end portions of each modular coaxial connector mounting flange structure enable adjacent coaxial connector mounting flange structures to effectively overlap each other when a plurality of the coaxial connector mounting flange structures are disposed within a longitudinal, horizontally oriented array.

In this manner, not only can the longitudinal extent of the longitudinal array of the plurality of coaxial connector mounting flange structures be minimized, but in addition, the overall longitudinal extent or dimension of the radio frequency system subassembly can be reduced as compared to the overall longitudinal extent or dimension of a radio frequency system subassembly having standard coaxial connector mounting flange structures mounted thereon. This structural arrangement renders the radio frequency system subassembly more spatially efficient than conventional, PRIOR ART radio frequency system subassemblies which is especially important within those environments, such as, for example, military aircraft, satellites, commercial aircraft, and the like, wherein the amount of space that is available for accommodating electronic apparatus is always at a premium. Still further, the overlapped end portions of the adjacent coaxial connector mounting flange structures can effectively be secured onto the radio frequency system subassembly by means of a common fastener thereby effectively reducing the number of fasteners, and the corresponding time to install such fasteners, which are required to secure the plurality of coaxial connector mounting flange structures upon the radio frequency system subassembly.

Lastly, it is noted that, in light of the foregoing disclosure, many variations and modifications of the present invention are possible. It is therefore to be understood that within the scope of the appended claims, the present invention may be practiced otherwise than as specifically described herein.

What is claimed as new and desired to be protected by Letters Patent of the United States of America, is:

1. A coaxial connector mounting flange structure, adapted to be mounted upon a radio frequency system subassembly so as to electrically connect a coaxial electrical connector to a hermetically sealed field replaceable pin which is mounted upon the radio frequency system subassembly and which is electrically connected to circuit components of the radio frequency system subassembly, comprising:

a central body portion;

a coaxial electrical connector mounted upon said central body portion;

a pair of oppositely disposed end portions extending laterally outwardly from said central body portion in opposite directions;

aperture means respectively defined within each one of said pair of oppositely disposed end portions for permitting a fastener to pass through said aperture means in order to fixedly mount said coaxial connector mounting flange structure upon the radio frequency system subassembly; and means defined upon each one of said pair of oppositely disposed end portions for permitting adjacent ones of said oppositely disposed end portions, disposed upon a pair of adjacent coaxial connector mounting flange structures, to be overlapped with respect to each other, when a plurality of said coaxial connector mounting flange structures are disposed within a linear array, such that a single fastener can be inserted through both of said aperture means defined within said overlapped oppositely disposed end portions of said pair of adjacent coaxial connector mounting flange structures whereby the longitudinal extent of the linear array of said coaxial connector mounting flange structures can be minimized so as to, in turn, minimize the longitudinal extent of the radio frequency system subassembly.

2. The coaxial connector mounting flange structure as set forth in claim 1, wherein:

said means defined within each one of said pair of oppositely disposed end portions for permitting adjacent ones of said oppositely disposed end portions of adjacent coaxial connector mounting flange structures to be overlapped with respect to each other comprises relieved portions defined within opposite front and rear surface portions of said pair of oppositely disposed end portions.

3. The coaxial connector mounting flange structure as set forth in claim 2, wherein:

said central body has a predetermined thickness dimension; and said relieved portions have thickness dimensions which are approximately one half said predetermined thickness dimension of said central body portion.

4. The coaxial connector mounting flange structure as set forth in claim 1, wherein:

said means defined within each one of said pair of oppositely disposed end portions for permitting adjacent ones of said oppositely disposed end portions of adjacent coaxial connector mounting flange structures to be overlapped with respect to each other comprises recessed portions defined within opposite front and rear surface portions of said pair of oppositely disposed end portions.

5. The coaxial connector mounting flange structure as set forth in claim 4, wherein:

said central body has a predetermined thickness dimension; and said recessed portions have thickness dimensions which are approximately one half said predetermined thickness dimension of said central body portion.

6. The coaxial connector mounting flange structure as set forth in claim 1, wherein:

said means defined within each one of said pair of oppositely disposed end portions for permitting adjacent ones of said oppositely disposed end portions of adjacent coaxial connector mounting flange structures to be overlapped with respect to each other comprises offset portions defined within opposite front and rear surface portions of said pair of oppositely disposed end portions.

7. The coaxial connector mounting flange structure as set forth in claim 6, wherein:

said central body has a predetermined thickness dimension; and said offset portions have thickness dimensions which are approximately one half said predetermined thickness dimension of said central body portion.

8. A linear array of coaxial connector mounting flange components, adapted to be mounted upon a radio frequency system subassembly so as to electrically connect a plurality of coaxial electrical connectors to hermetically sealed field replaceable pins which are mounted upon the radio frequency system subassembly and which are electrically connected to circuit components of the radio frequency system subassembly, wherein each one of said coaxial connector mounting flange components comprises:

a central body portion;

a coaxial electrical connector mounted upon said central body portion;

a pair of oppositely disposed end portions extending laterally outwardly from said central body portion in opposite directions;

aperture means respectively defined within each one of said pair of oppositely disposed end portions for permitting a fastener to pass through said aperture means in order to fixedly mount said coaxial connector mounting flange component upon the radio frequency system subassembly; and means defined upon each one of said pair of oppositely disposed end portions for permitting adjacent ones of said oppositely disposed end portions, disposed upon a pair of adjacent coaxial connector mounting flange components, to be overlapped with respect to each other, when a plurality of said coaxial connector mounting flange components are disposed within said linear array, such that a single fastener can be inserted through both of said aperture means defined within said overlapped oppositely disposed end portions of said pair of adjacent coaxial connector mounting flange components whereby the longitudinal extent of said linear array of said coaxial connector mounting flange components can be minimized so as to, in turn, minimize the longitudinal extent of the radio frequency system subassembly.

9. The linear array of coaxial connector mounting flange components as set forth in claim 8, wherein:

said means defined within each one of said pair of oppositely disposed end portions for permitting adjacent ones of said oppositely disposed end portions of adjacent coaxial connector mounting flange components to be overlapped with respect to each other comprises relieved portions defined within opposite front and rear surface portions of said pair of oppositely disposed end portions.

10. The linear array of coaxial connector mounting flange components as set forth in claim 9, wherein:

said central body has a predetermined thickness dimension; and said relieved portions have thickness dimensions which are approximately one half said predetermined thickness dimension of said central body portion.

11. The linear array of coaxial connector mounting flange components as set forth in claim 8, wherein:

said means defined within each one of said pair of oppositely disposed end portions for permitting adjacent ones of said oppositely disposed end portions of adjacent coaxial connector mounting flange components to be overlapped with respect to each other comprises recessed portions defined within opposite front and rear surface portions of said pair of oppositely disposed end portions.

12. The linear array of coaxial connector mounting flange components as set forth in claim 11, wherein:

said central body has a predetermined thickness dimension; and said recessed portions have thickness dimensions which are approximately one half said predetermined thickness dimension of said central body portion.

13. The linear array of coaxial connector mounting flange components as set forth in claim 8, wherein:

said means defined within each one of said pair of oppositely disposed end portions for permitting adjacent ones of said oppositely disposed end portions of adjacent coaxial connector mounting flange components to be overlapped with respect to each other comprises offset portions defined within opposite front and rear surface portions of said pair of oppositely disposed end portions.

14. The linear array of coaxial connector mounting flange components as set forth in claim 13, wherein:

said central body has a predetermined thickness dimension; and said offset portions have thickness dimensions which are approximately one half said predetermined thickness dimension of said central body portion.

15. The linear array of coaxial connector mounting flange components as set forth in claim 8, wherein:

said aperture means are respectively defined within said pair of oppositely disposed end portions of each one of said coaxial connector mounting flange components such that when adjacent ones of said oppositely disposed end portions of adjacent ones of said coaxial connector mounting flange components disposed within said linear array are overlapped with respect to each other, said aperture means respectively defined within said pair of oppositely disposed end portions of said adjacent ones of said coaxial connector mounting flange components will be coaxially aligned with respect to each other so as to permit a single fastener to pass through said aperture means respectively defined within said pair of oppositely disposed end portions of said adjacent ones of said coaxial connector mounting flange components in order to fixedly mount said adjacent ones of said coaxial connector mounting flange components upon the radio frequency system subassembly.

16. The linear array of coaxial connector mounting flange components as set forth in claim 8, further comprising:

spacer means for use with endmost ones of said coaxial connector mounting flange components of said linear array of coaxial connector mounting flange components for ensuring that the fasteners will be properly seated upon said end portions of said endmost ones of said coaxial connector mounting flange components of said linear array of coaxial connector mounting flange components so as to properly fixedly mount said endmost ones of said coaxial connector mounting flange components of said linear array of coaxial connector mounting flange components upon the radio frequency system subassembly.

17. In combination, a radio frequency system subassembly and a linear array of coaxial connector mounting flange components, adapted to be mounted upon said radio frequency system subassembly so as to electrically connect a plurality of coaxial electrical connectors to hermetically sealed field replaceable pins which are mounted upon said radio frequency system subassembly and which are electrically connected to circuit components of said radio frequency system subassembly, comprising:

a radio frequency system subassembly; and a plurality of coaxial connector mounting flange components mounted upon said radio frequency system subassembly within a linear array; and fastener means for fixedly mounting said plurality of coaxial connector mounting flange components upon said radio frequency system subassembly;

wherein each one of said coaxial connector mounting flange components comprises a central body portion; a coaxial electrical connector mounted upon said central body portion; a pair of oppositely disposed end portions extending laterally outwardly from said central body portion in opposite directions; aperture means respectively defined within each one of said pair of oppositely disposed end portions for permitting said fastener means to pass through said aperture means in order to fixedly mount said coaxial connector mounting flange component upon said radio frequency system subassembly; and means defined upon each one of said pair of oppositely disposed end portions for permitting adjacent ones of said oppositely disposed end portions, disposed upon a pair of adjacent coaxial connector mounting flange components, to be overlapped with respect to each other, when a plurality of said coaxial connector mounting flange components are disposed within said linear array, such that a single fastener can be inserted through both of said aperture means defined within said overlapped oppositely disposed end portions of said pair of adjacent coaxial connector mounting flange components whereby the longitudinal extent of said linear array of said coaxial connector mounting flange components can be minimized so as to, in turn, minimize the longitudinal extent of the radio frequency system subassembly.

18. The combination as set forth in claim 17, wherein:

said aperture means are respectively defined within said pair of oppositely disposed end portions of each one of said coaxial connector mounting flange components such that when adjacent ones of said oppositely disposed end portions of adjacent ones of said coaxial connector mounting flange components disposed within said linear array are overlapped with respect to each other, said aperture means respectively defined within said pair of oppositely disposed end portions of said adjacent ones of said coaxial connector mounting flange components will be coaxially aligned with respect to each other so as to permit a single one of said fastener means to pass through said aperture means respectively defined within said pair of oppositely disposed end portions of said adjacent ones of said coaxial connector mounting flange components in order to fixedly mount said adjacent ones of said coaxial connector mounting flange components upon said radio frequency system subassembly.

19. The combination as set forth in claim 17, further comprising:

spacer means for use with endmost ones of said coaxial connector mounting flange components of said linear array of coaxial connector mounting flange components for ensuring that said fastener means will be properly seated upon said end portions of said endmost ones of said coaxial connector mounting flange components of said linear array of coaxial connector mounting flange components so as to properly fixedly mount said endmost ones of said coaxial connector mounting flange components of said linear array of coaxial connector mounting flange components upon said radio frequency system subassembly.

20. The combination as set forth in claim 17, wherein:

said means defined within each one of said pair of oppositely disposed end portions for permitting adjacent ones of said oppositely disposed end portions of adjacent coaxial connector mounting flange components to be overlapped with respect to each other comprises relieved portions defined within opposite front and rear surface portions of said pair of oppositely disposed end portions;

said central body has a predetermined thickness dimension; and said relieved portions have thickness dimensions which are approximately one half said predetermined thickness dimension of said central body portion.

* * * * *